United States Patent [19]

Smith

[11] Patent Number: 4,461,119

[45] Date of Patent: Jul. 24, 1984

[54] PICTURE WINDOW STORM WINDOW

[76] Inventor: Samuel C. Smith, 210 Hartman Rd., Newton Centre, Mass. 02159

[21] Appl. No.: 422,151

[22] Filed: Sep. 23, 1982

[51] Int. Cl.[3] ..... E01F 13/00

[52] U.S. Cl. ..... 49/34; 49/62; 49/465; 160/105

[58] Field of Search ..... 49/34, 62, 465; 160/105, 230

[56] References Cited

U.S. PATENT DOCUMENTS

| | | | |
|---|---|---|---|
| 732,693 | 7/1903 | Adams | 160/105 |
| 933,782 | 9/1909 | Darnell | 160/230 |
| 2,645,789 | 7/1953 | Wisner, Jr. | 49/465 X |
| 3,787,794 | 1/1974 | Schmidt et al. | 160/230 X |
| 4,201,123 | 5/1980 | Maciag et al. | 49/34 X |

*Primary Examiner*—Kenneth Downey

[57] ABSTRACT

There is disclosed in the present application a foldable picture window storm window. It consists of a frame whose lower and upper sections are made to swivel such that the storm window can be folded, easily transported and stored; yet, does not adversely affect the view.

4 Claims, 5 Drawing Figures

PICTURE WINDOW STORM WINDOW

The present invention relates generally to improvements in storm windows of large area which are provided with foldable frames.

Picture windows of considerable height, width and area have become increasingly popular in modern homes; however, particularly as a result of fuel costs in the recent past, such windows are considered economically wastefull.

Heretofore, beautiful scenery and the effect of viewing a live picture, were sufficient attractions to overlook the extra costs entailed. Today, where heating costs and cooling efficiency are important considerations, a decision to have storm windows cannot preclude such factors as a choice between either heavy or double pane glass, on the one hand; and single pane with the use of storm windows, on the other hand. In the former case, the expense is exhorbitant; in the latter, transporting and storing the storm window are not easy tasks.

Accordingly, an object of the invention is to improve the efficiency of buildings, particularly those including windows of large area.

Another general object is to enhance the efficiency of buildings but to do so economically.

A related object is to prevent a heat loss through large windows of buildings.

The foregoing objects are achieved by a foldable storm window assembly which is particularly suitable for windows. The whole frame assembly consists of two U-shaped members joined together by an intermediate pair of members.

According to a feature of the invention, the assembly includes a foldable frame having an intermediate section to the center of which a relatively thin, highly transparent, scratch-resistant, flexible plastic sheet is secured. From a point approximately two inches from the end of each "U", the sheet is continuously fastened to the remainder of the frame but is only locally secured to the intermediate member which is hingedly connected at its ends to form a convenient radius of approximately 6 inches. In addition, a strip of compressible foam gasket is secured to the outer surface of the frame to provide sealing for the assembly against the related window structure and four jack screws serve as means of handling in installing and removing the storm window as well as assisting in retaining same in position.

The foregoing objects and features of the present invention will be better understood from the following detailed description of an illustrative embodiment taken in connection with the accompanying drawings in which.

The present storm window assembly indicated at 8 comprises a foldable frame including vertical members

Figure 5:
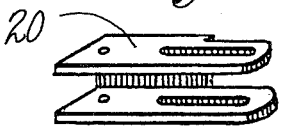
FIG. 5 is a detailed view in perspective of a sliding hinge member of the storm window shown in the previous figures.

10, upper horizontal members 12 and 14, lower horizontal members 16 and 18 and upper and lower intermediate horizontal members one of which is indicated at 19. The frame members are preferably of metal tubing such as aluminum but may alternatively be of wood. Horizontal member 14 and 18 are fixedly secured as by welding to a vertical member 10 to form a first generally C-shaped frame section. The horizontal members 12 and 16 are similarly joined to another vertical member 10 to form a second generally C-shaped section. Each of the frame sections 12, 14 and 16, 18 carries on the inner ends of its horizontal members, a hinge 20 secured by a fixed fastener 21 and formed of two spaced-apart slotted plates as shown in FIG. 5, each of which embraces one of the ends of an intermediate member 19 to which it is secured by the fastener 21. The hinge 20 provides a sliding connection with a pin 22 passing loosely through a slot in the hinge and fixedly secured in the intermediate member 19. There is secured by a suitable adhesive to the outer surface of the frame sections 14, 18 and 12, 16 and to the intermediate members 19, a strip of compressible foam gasket 24 extending outwardly beyond the frame to provide sealing for the assembly 8 against the related window structure.

The parts of the gasket 24 covering the intermediate member 19 extends beyond the ends of the members and is formed with bevelled ends complementing adjacent ends of the gasket on the frame sections 14, 18 and 12, 16 to provide an effective seal.

A plastic sheet 26 is secured by a washer headed fastener 28 to the mid point of each of the intermediate members 19. The margin of the sheet 26 is cemented or otherwise fastened continuously to the frame sections 14, 18 and 12, 16 except for a free interval adjacent to the intermediate member 19.

Figure 1:
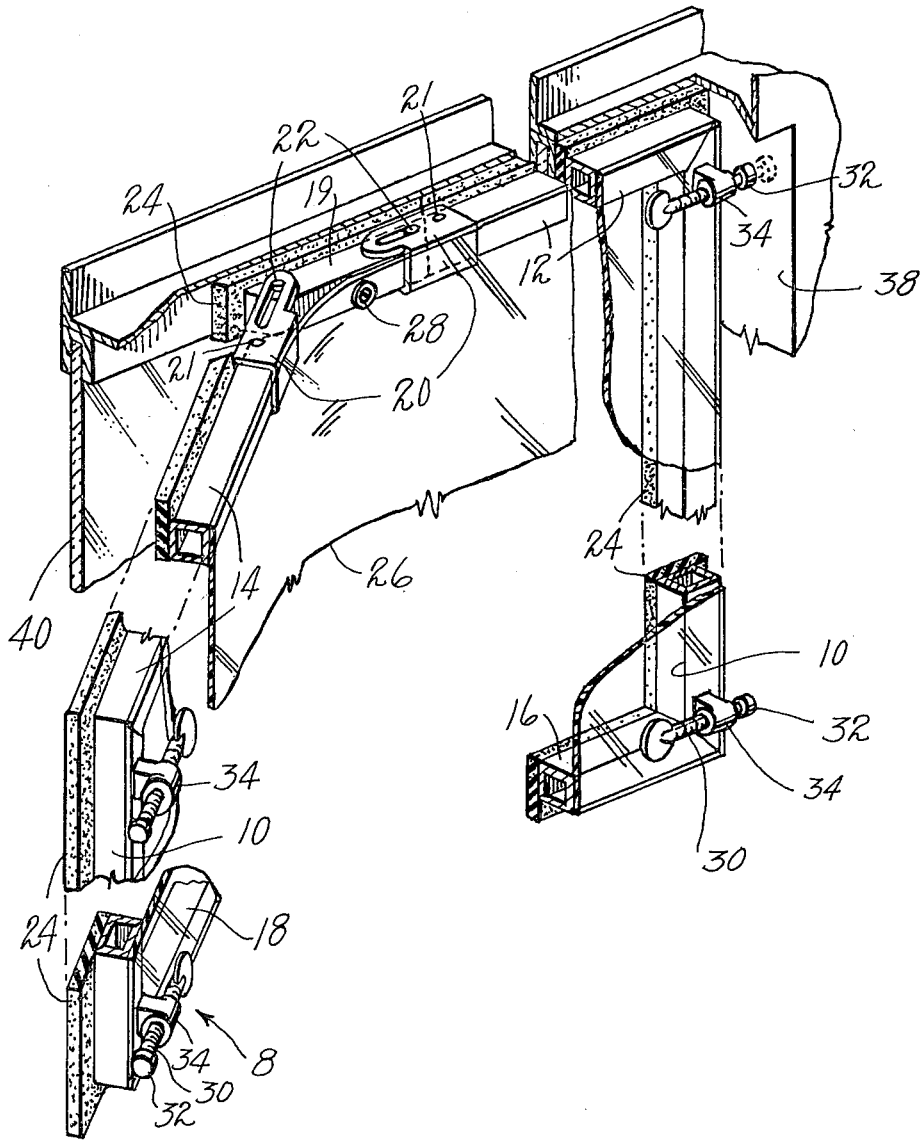
FIG. 1 is a partial perspective view of the storm window according to the present invention.
Figure 3:
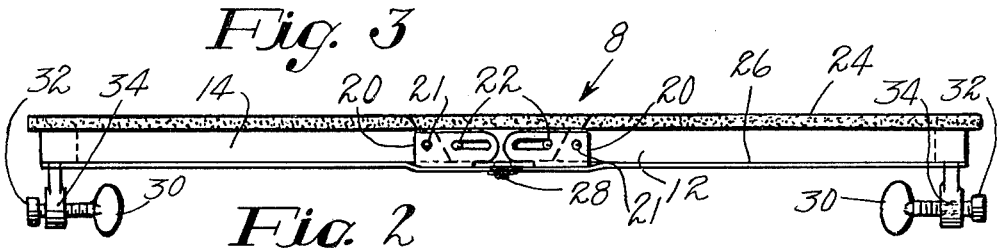
FIG. 3 is a view in plan elevation of the storm window according to the present invention.
Figure 2:
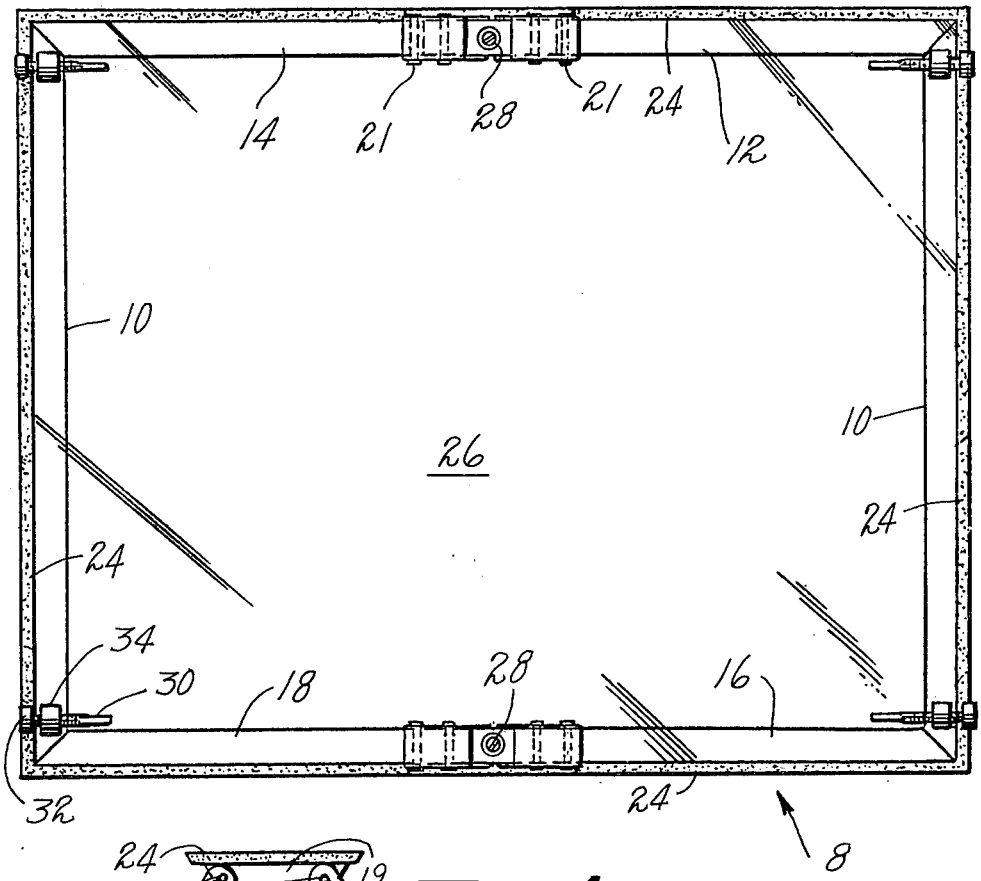
FIG. 2 is a view of an assembly of the storm window according to the present invention as seen from the front.
Figure 4:
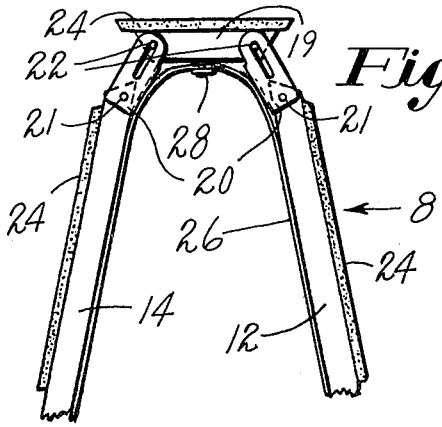
FIG. 4 is a fragmentary plan view of the storm window and illustrating a folding characteristic of the window.

As seen in FIG. 4, the connection of the sheet 26 to the frame members allows the assembly to be folded for removal and storage as the sheet 26 is curved undamaged about a radius of approximately six inches but the sheet mounting affords a ripple-free sight when installed. In practice, a thin plastic sheet, preferably between 0.015 and 0.025 inch and coated with a scratch-resistant finish has been found effective for the purpose.

A set of four jack screws is secured to the frame, one near each corner, each including a screw 30 provided with a rubber tip 32 and in threaded engagement with a nut 34 affixed to one of the vertical members 10. The jack screws assist in securing the assembly 8 within the window frame and also provide a convenient grip for installation and removal of the assembly.

In essence, the picture window storm window is a valuable item not only for new buildings but also for old ones whose owners have to live with their existing windows.

From the above description of an illustrative embodiment, taken in connection with the accompanying drawings, many variations within the scope of the invention will become apparent to those of ordinary skill in the art. It is therefore not intended that the specification and drawings be taken in a limiting sense but rather that the scope of the invention be interpreted in terms of the appended claims.

Having thus disclosed my invention, what I claim as new and desire to secure by Letters Patent of the United States is:

1. A storm window assembly for an elongated window comprising a foldable frame including a pair of spaced-apart intermediate frame members, extending along the length of the frame, a pair of generally C-shaped rigid frame end sections each hingedly connected at its ends to the ends of the intermediate frame members, a flexible unitary transparent plastic sheet secured continuously at its end portions to each of the frame sections along most of their lengths leaving the generally centrally located margin of the sheet adjacent the frame sections free of the frame sections and means securing a limited central portion of the sheet to the intermediate members near their mid-points but leaving the remainder of the margin of the sheet free of the intermediate member, whereby the sheet is stretched taut longitudinally when the assembly is installed and curved about a relatively large radius as the sections are folded closer together.

2. A storm window assembly according to claim 1 further characterized in that the frame is of rectangular configuration and further comprising a set of jack screws, one near each of the corners of the frame, adapted to secure the storm window assembly in the frame of a window in which the assembly is installed.

3. A storm window assembly according to claim 1, further comprising a compressible foam gasket fixedly retained on the outer frame surface in spaced relationship with the sheet.

4. A storm window assembly according to claim 1, wherein the means for connecting each end of each C-shaped rigid frame member to the intermediate frame member comprises a pair of spaced-apart slotted plates affixed to the C-shaped members and embracing the intermediate member and a pin fixed to the intermediate member and passing loosely through the slots.

* * * * *